US008534160B2

(12) United States Patent
Giuliani et al.

(10) Patent No.: US 8,534,160 B2
(45) Date of Patent: Sep. 17, 2013

(54) RETRACTABLE CONTROL DEVICE FOR DOMESTIC APPLIANCE

(75) Inventors: Marco Giuliani, Travedona Monate (IT); Michele Venezia, Taino (IT); Tomasz Rydel, Wroclaw (PL); Marcin Mazurek, Radwanice (PL); Sacha Mello, Busto Arsizio (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/363,803

(22) Filed: Feb. 1, 2012

(65) Prior Publication Data

US 2012/0198958 A1 Aug. 9, 2012

(30) Foreign Application Priority Data

Feb. 4, 2011 (IT) ..... MI2011A0161

(51) Int. Cl.
*G05G 1/02* (2006.01)
*G05G 1/08* (2006.01)

(52) U.S. Cl.
CPC . *G05G 1/08* (2013.01); *G05G 1/087* (2013.01)
USPC ..... 74/553; 74/554; 338/215; 16/441; 200/325

(58) Field of Classification Search
USPC ..... 74/553, 554; 248/188.8, 649, 677; 200/325
IPC ..... G05G 1/10; F24C 3/12
See application file for complete search history.

(56) References Cited

U.S. PATENT DOCUMENTS

| | | | | |
|---|---|---|---|---|
| 3,517,570 | A * | 6/1970 | Kolb | 74/527 |
| 3,878,731 | A * | 4/1975 | Huegli | 74/10.8 |
| 4,201,096 | A * | 5/1980 | Morrison et al. | 74/531 |
| 5,121,653 | A * | 6/1992 | Sigler | 74/553 |
| 5,384,442 | A | 1/1995 | Danner | |

(Continued)

FOREIGN PATENT DOCUMENTS

| | | |
|---|---|---|
| EP | 0276463 B1 | 9/1993 |
| EP | 797052 | 9/1997 |

(Continued)

OTHER PUBLICATIONS

European Patent Application No. 12151683.5, Applicant: Whirlpool Corporation, Extended Search Report dated Feb. 10, 2012.

(Continued)

*Primary Examiner* — Richard W Ridley
*Assistant Examiner* — William Santosa
(74) *Attorney, Agent, or Firm* — Daniel M. Blakeslee

(57) ABSTRACT

A retractable control device for a household electrical appliance includes a knob movable against an elastic member within an aperture or seat of a control interface of the appliance. The knob is configured to assume two working positions including a first position in which the knob is seated in the aperture and a second position in which the knob extends outwardly therefrom. The knob cooperates with a control member for a functional element of the appliance, such as an electrical resistance heater or microwave generator of an oven, or a gas burner of a cooking hob. The device also includes a cylindrical element disposed and fixed in the aperture of the control interface about the knob. The cylindrical element contains the knob when the knob is in its first position and guides its movement within the aperture along a central longitudinal axis thereof.

10 Claims, 5 Drawing Sheets

(56) References Cited

U.S. PATENT DOCUMENTS

| | | | | |
|---|---|---|---|---|
| 7,870,810 | B2 * | 1/2011 | Da Dalt et al. | 74/553 |
| 7,943,878 | B2 * | 5/2011 | Hamm | 200/316 |
| 8,038,117 | B2 * | 10/2011 | Chen et al. | 248/677 |
| 2005/0039305 | A1 * | 2/2005 | Chirumbolo | 16/441 |
| 2010/0181181 | A1 * | 7/2010 | Hamm | 200/600 |
| 2010/0194521 | A1 * | 8/2010 | Baier | 338/215 |
| 2011/0061489 | A1 * | 3/2011 | Bulin et al. | 74/553 |

FOREIGN PATENT DOCUMENTS

| | | | |
|---|---|---|---|
| EP | 0797052 | B1 | 9/1997 |
| EP | 1712974 | A1 * | 10/2006 |
| FR | 9213946 | | 11/1992 |
| FR | 2698459 | | 5/1994 |

OTHER PUBLICATIONS

European Patent Application No. 12151683.5, Applicant: Whirlpool Corporation, Publication No. EP2485111A1, published Aug. 8, 2012.

* cited by examiner

RETRACTABLE CONTROL DEVICE FOR DOMESTIC APPLIANCE

This application claims priority under 35 U.S.C. §119(b) to Italian Patent Application No. MI2011A000161, which was filed Feb. 4, 2011, the subject matter of which is incorporated herein by reference.

The present invention relates to a retractable control device for household electrical appliances.

Devices of the aforesaid type have been used for some time in household electrical appliances: they are used on user interfaces to allow the control of appliance functional elements (such as the electrical resistance heater or microwave generator of an oven, or a gas burner of a cooking hob) while at the same time enabling the appliance to present a pleasant appearance when not in use. For this purpose, a known device of the stated type comprises a pushbutton or knob inserted into an aperture or seat in the interface; this knob is movable therein under the action of a spring or an elastically loaded body such as to assume two working positions, in a first of which it is inserted into its seat in the user interface such that its flat or substantially flat end lies substantially coplanar with the interface, and in the second of which it projects from said aperture.

The knob cooperates with a control member of said appliance functional element, which can be a simple shaft rotating about a longitudinal axis thereof, usually coinciding with the central axis through the aperture or seat for the knob (and along which this latter moves), or a complex body defining a so-called push-pull control comprising coupled parts longitudinally movable relative to each other against the action of an elastic element. In both cases this control member is connected to the appliance functional element to enable its activation and operational adjustment by operating the knob.

The control member is positioned below the user interface and is at least partly contained in a knob support which can be a cup-shaped member or a tubular body.

With particular but non-limiting reference to those control devices with a push-pull member, it can happen that the movable knob is not always centered within the aperture or seat in which it moves and that, when in its second working position (knob extracted), this knob oscillates in planes perpendicular to the longitudinal axis of the seat in which it moves. This causes wear of the material (usually plastic) of the knob and/or of the support for the knob and/or of the parts connected to this latter; this is also because of the spaces present between the constituent parts of the control device and of their constructional tolerances.

FR2698459 describes a pushbutton or knob controlling a rotary support shaft, in particular of a heating and air conditioning system of a vehicle on which this knob is mounted and axially slidable against a spring. The knob moves within an aperture or seat of a panel from which it can project into a working position; the drawings show that at the aperture this panel presents a substantially undercut socket-shaped portion in the knob seat. The pushbutton slides within this panel portion, its movement guided by the cooperation between a groove provided on its body, slidable on a shaft fixed to an insulating plate carrying conductive tracks, and a pin carried by a rod positioned on a panel fixed to the shaft.

EP797052 describes a knob switch inserted movable within an aperture in a vitreous ceramic plate of a cooking hob. This aperture is surrounded by a protection ring below which a seal ring is present.

The seal ring is in contact with the knob even when it emerges from the aperture or seat in the plate to control the appliance heating element.

An object of the present invention is to provide a retractable control device for a household electrical appliance in which the knob is centered within its seat and in which the knob oscillations in planes perpendicular to the longitudinal axis of said seat along which the knob moves are possibly limited.

Another object is to provide a control device of the stated type which is of reliable use, of low cost and offers to the user a sensation of robustness and considerable attractiveness.

These and other objects which will be apparent the expert of the art are attained by a control device in accordance with the accompanying claims.

The present invention will be more apparent from the accompanying drawings, which are provided by way of non-limiting example and in which.

Figure 1:
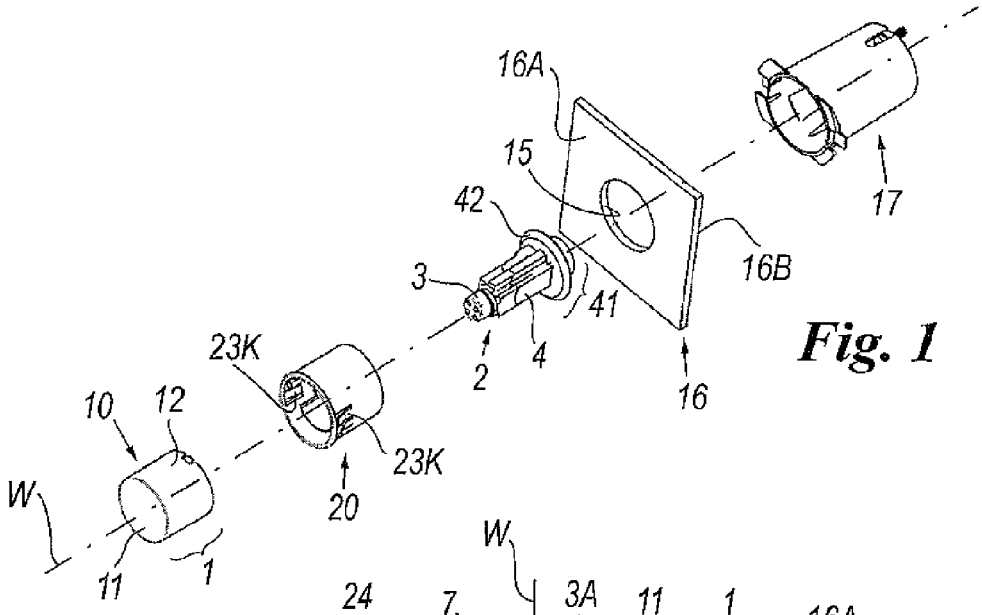
FIG. 1 is an exploded view of a device according to the invention.

With reference to said figures, a control device comprises a knob 1 associated with a push-pull control member 2 of known type comprising two elements 3 and 4 slidingly movable one on the other against a spring 5. A (movable) first element 3 of this member 2 presents a free end 3A inserted into a preferably cylindrical seat 7 provided in the interior of the knob 1 and coupled thereto in that manner.

The knob 1 presents a cup-shaped body 10 having a substantially flat first end part 11 from which a perimetral cylindrical wall 12 projects. The knob is to be disposed in an aperture or seat 15 of a user plate or interface 16 of a household electrical appliance, for example an oven.

This plate has a face or surface 16A facing the user and a face or surface 16B facing the appliance interior.

On this latter face 16B a cylindrical body 17 is present acting as a support for the knob and for the control member 2, said body 17 being connected to an electronic selector 18 of known type (visible in FIGS. 7-9) cooperating with said member in known manner and hence not described.

Figure 2:
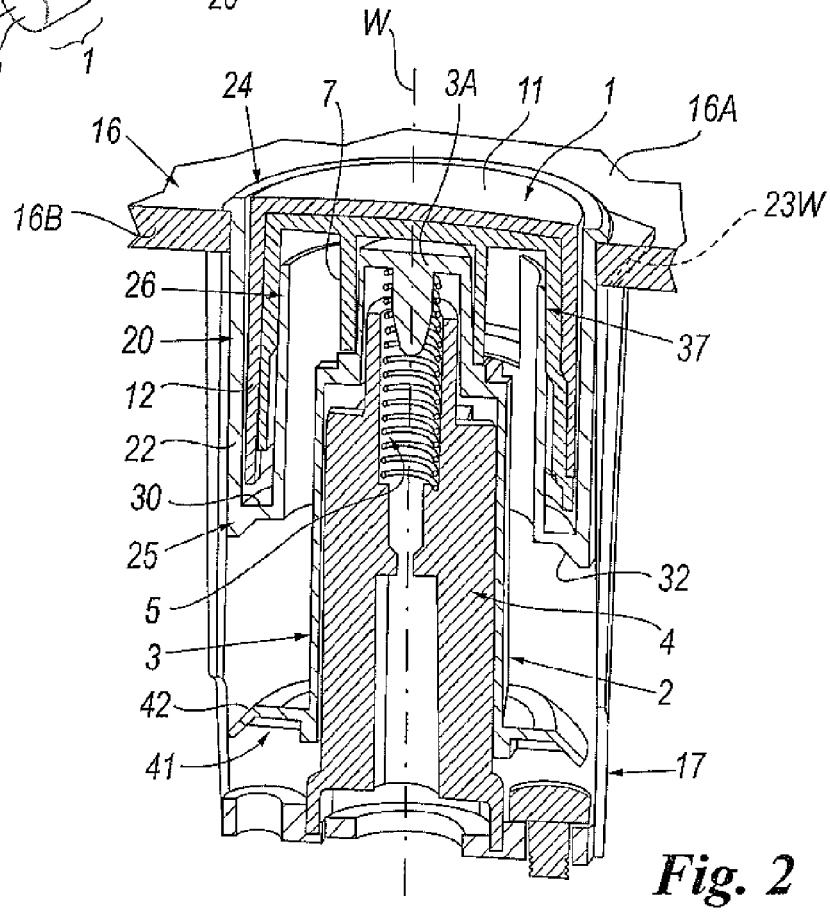
FIG. 2 is a cross-section through the device of FIG. 1 in a first working position.
Figure 3:
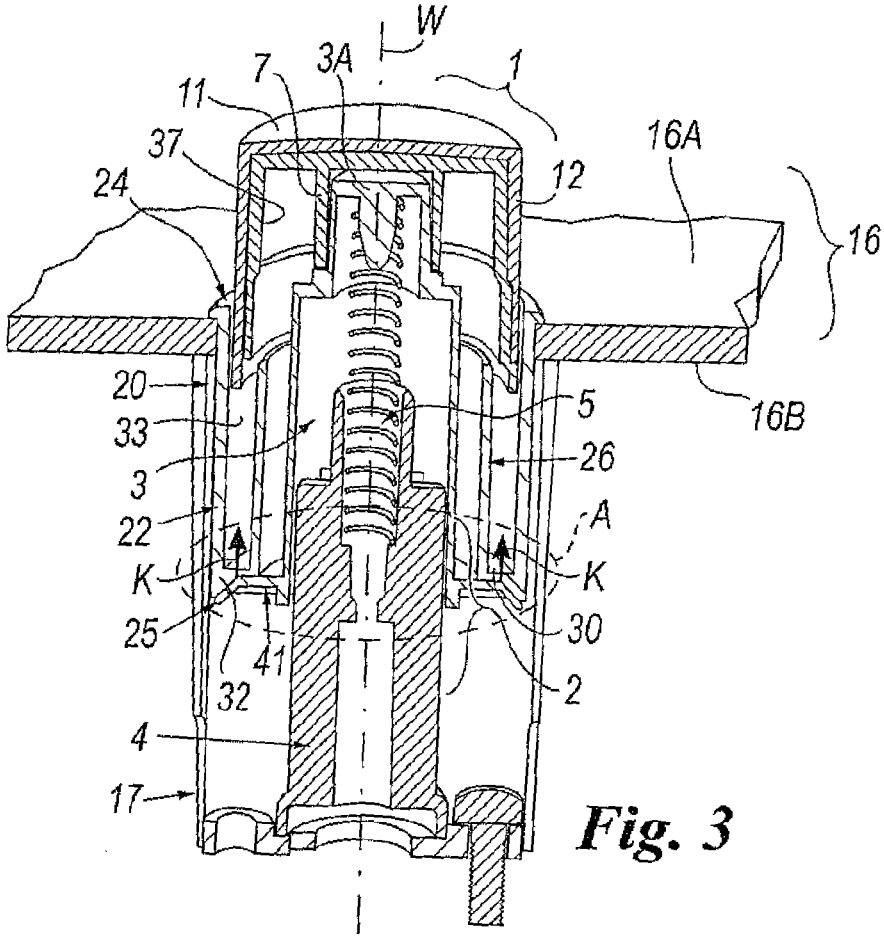
FIG. 3 is a view similar to that of the device of FIG. 2, but in a different working position.
Figure 4:
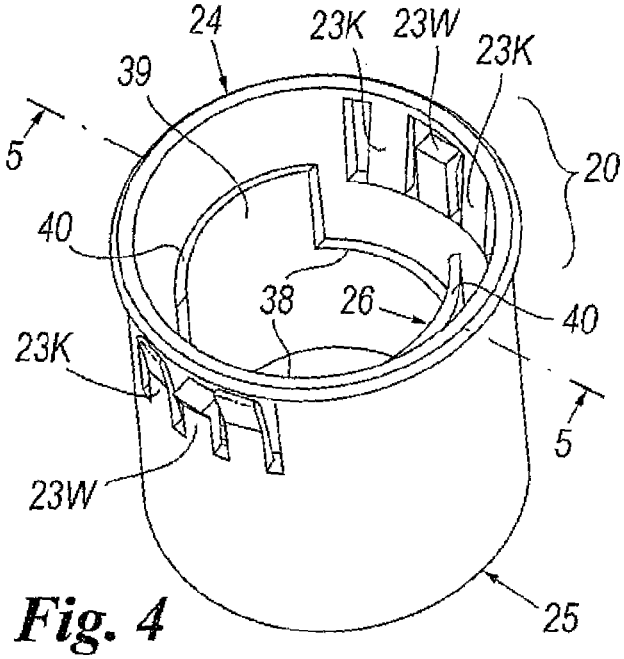
FIG. 4 is a perspective view of a detail of the device of FIG. 2.
Figure 5:
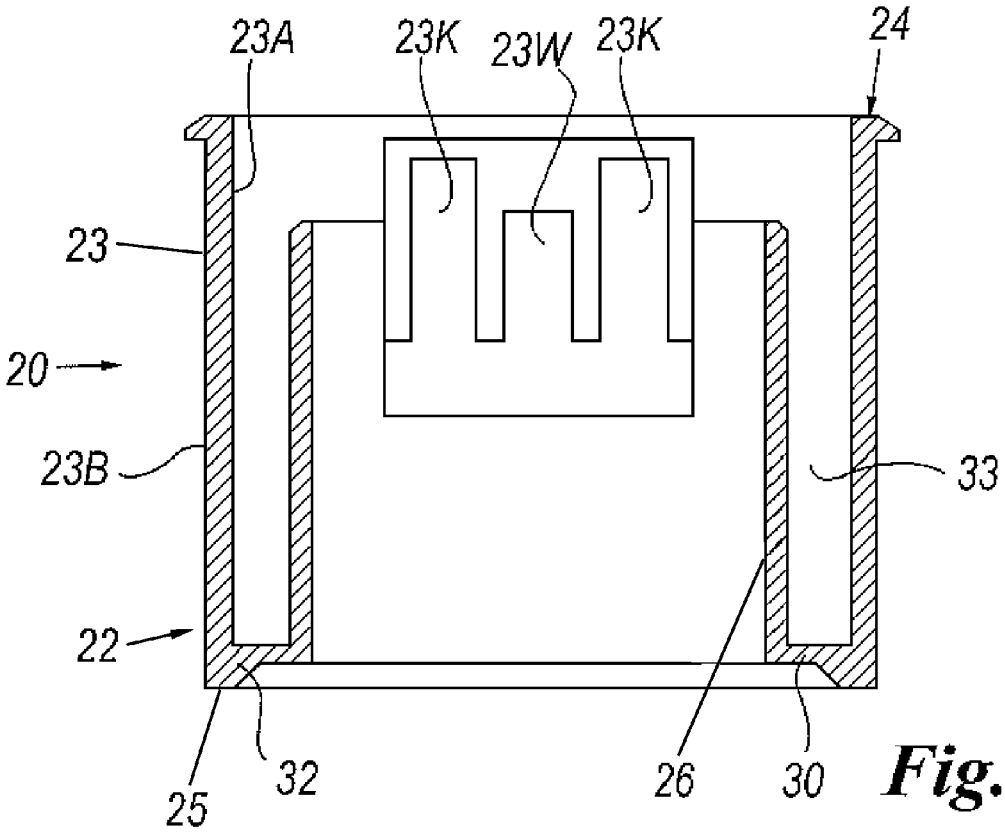
FIG. 5 is a section taken on the line 5-5 of FIG. 4.
Figure 6:
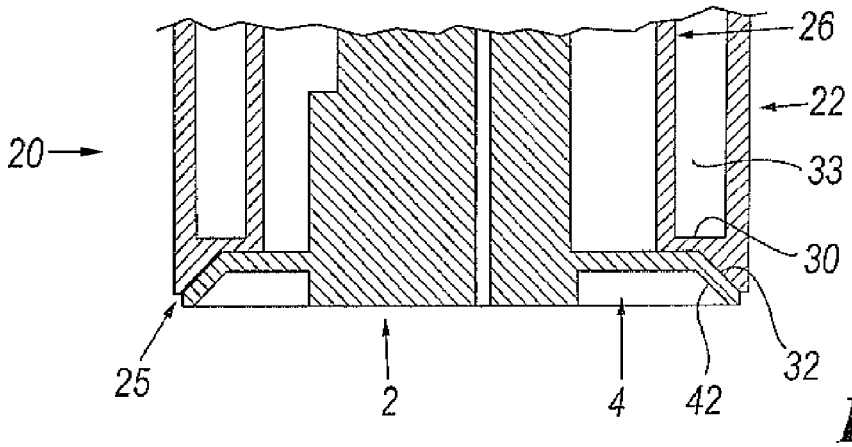
FIG. 6 is an enlarged view of the part indicated by A in FIG. 3.

The knob 1 can assume two working positions, in a first position it being inserted in its seat 15 (and partially in the body 17) with its end 11 substantially coplanar with the face 16A (FIG. 2); in a second position the knob projects from the seat 15 beyond the face 16A (FIG. 3) to enable a user to act on the member 2 and activate a function of the appliance by rotating the knob about a longitudinal axis (coinciding with the axis W of the seat 15 and of the body 17) and activating the selector 18.

According to the invention, a cylindrical centering element 20 is positioned in the aperture or seat 15 of the user interface 16, between the latter and the knob 1, and is of dimensions sufficient to contain the knob 1 when this is in its first working position. The element 20 maintains the knob 1 in its first working position, with its axis coinciding with the central longitudinal axis W through the seat 15, to centre it within this latter; this cylindrical centering element 20 also prevents the knob from "oscillating" in planes perpendicular to the axis W when in its second working position.

More particularly, the cylindrical centering element 20 presents a tubular body 22 having a lateral wall 23 presenting an inner face 23A and an outer face 23B; the wall 23 comprises elastically deformable lugs 23K at least one of which presents perpendicularly projecting ends 23W, preferably of triangular section, to enable the tubular body 22 to be inserted into the seat 15 and be coupled to the interface 16, to hence be locked in this latter by the engagement between said ends 23W and the surface 16B of said interface. The tubular body 22 also presents a flanged first end 24 to rest on the surface 16A of the interface 16, and a second end 25 to be inserted into the cylindrical body 17.

In a first embodiment, shown in FIGS. 1-6, said cylindrical centering element 20 internally presents a cylindrical portion 26 coaxial to the tubular body 22 and connected thereto via an annular part 30 fixed to the end 25 of said body 22. This part is flared towards the axis W and hence comprises a portion of inclined surface 32 facing said axis.

The cylindrical portion 26 is similar in length to the tubular body 22 and defines therewith an annular interspace 33 to receive the perimetral wall 12 of the body 10 of the knob 1 when this latter is in its first working position, and to guide the movement of the knob from said position to the second working position (arrows K of FIG. 3), or vice versa.

By cooperation between the perimetral wall 12 and the face 23A of the wall 23 of the tubular body 22, said movement (and the opposite movement) takes place in a guided manner to maintain the knob coaxially with the axis W of the seat 15 and maintain it centered in its seat 15 (and in the body 17).

In addition, the knob body 10 comprises a cylindrical or conical inner collar 37, positioned along the wall 12 of this body. In said movement, said collar cooperates with the cylindrical portion 26 to hence improve the centering effect of the cylindrical element 20 on the knob.

Advantageously, said cylindrical portion presents two recesses 38 in proximity to its free end 39, to define two opposing lugs 40 in said portion 26; these lugs are flexible and by cooperating with the aforesaid inner collar 37 and/or with the cylindrical perimetral part 12, increase the centering effect on the knob 1 when in its second working position.

To prevent knob oscillation in a plane perpendicular to the axis W when in its second working position, the movable element 3 of the control member 2 or the cylindrical inner collar 37 presents a flanged end portion 41 which is flared inwards, i.e. it presents an inclined annular part 42. This inclination is equal to that of the portion 32 of the annular part 30 of the element 20 to hence enable the portion 41 to engage that part and element when the knob 1 is extracted from the seat 15. This means that by virtue of the contact between the portion 41 and the portion 32 any oscillation of the knob about the axis W is prevented because of the force exerted by the spring 5 which maintains the two portions in mutual contact.

Figure 7:
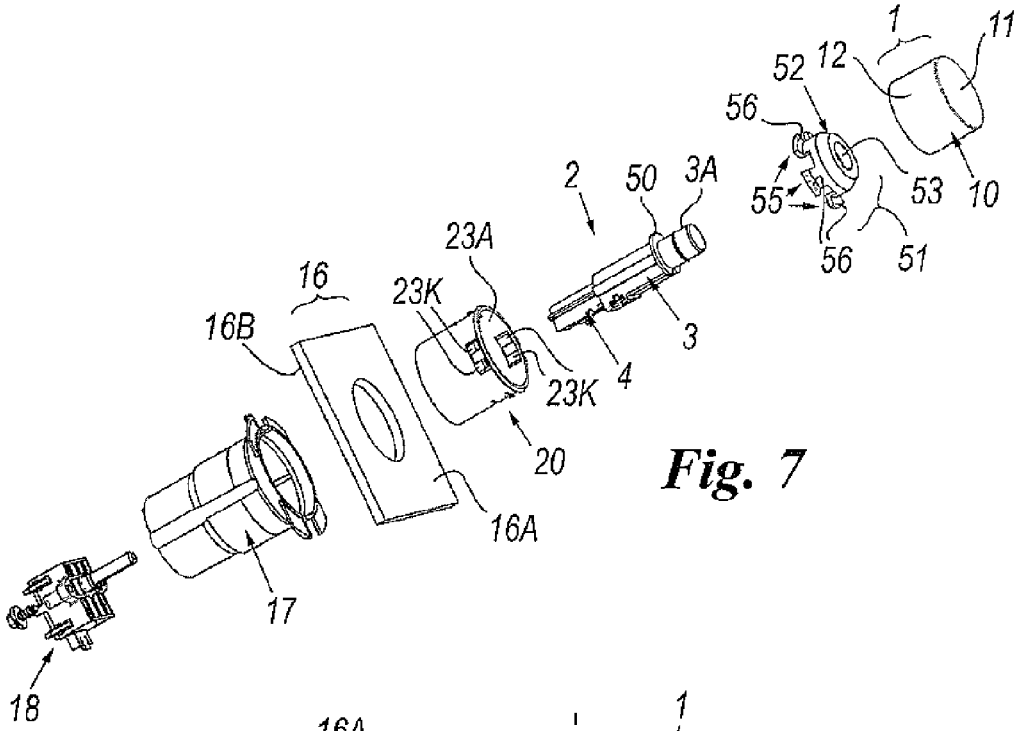
FIG. 7 is an exploded perspective view of a first variant of the invention.
Figure 8:
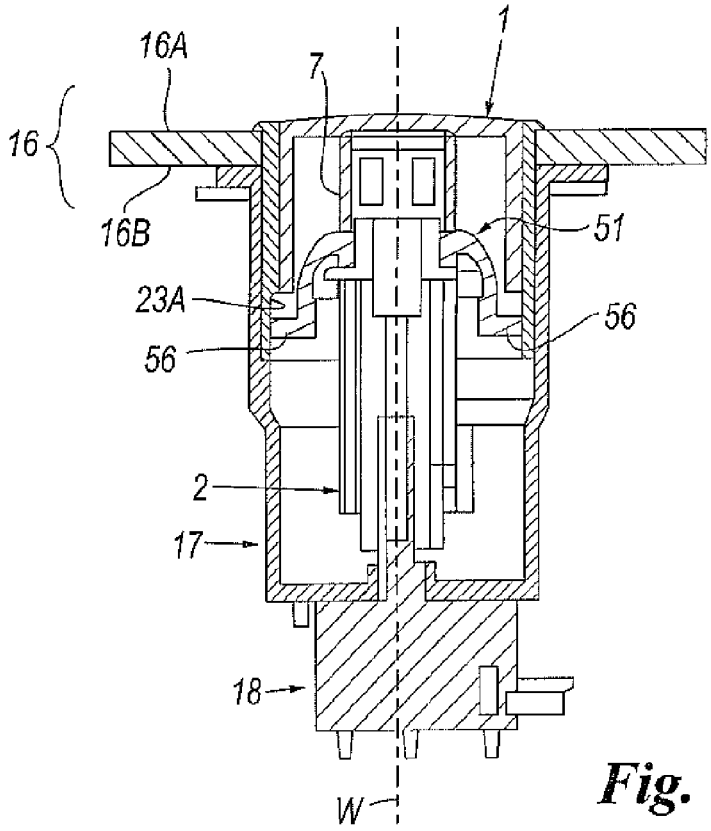
FIG. 8 is a cross-section through the variant of FIG. 7.

FIGS. 7 and 8, in which parts corresponding to those already described are indicated by the same reference numerals, show a first variant of the invention. In this latter, as in the preceding embodiment, the control member 2 comprises the two elements 3 and 4 movable relative to each other. The element 3 comprises, in proximity to its end 3A, a collar 50 supporting a body 51 which is substantially cup-shaped, but has an end portion 52 provided with a hole 53 enabling the end 3A of said element 3 to pass, for its insertion into the seat 7 of the knob 1.

This end portion is arranged to rest on the collar 50; peripherally projecting downwards (i.e. towards the underlying 2 and parallel to it) from this portion which is of substantially circular-based frusto-conical shape, there are lugs 55 distributed radially and terminating with feet 56 projecting perpendicularly from said lugs to elastically cooperate by interference with the inner face 23A of the cylindrical centering element 20 which, in the embodiment under examination, lacks the cylindrical portion 26 of FIGS. 1-6. The perimetral wall 12 of the knob 1 also directly cooperates with this inner face 23A (of diameter less than that of a circumference in which the ends of the lugs 55 lie).

By virtue of this embodiment, centering of the knob 15 on the axis W of the seat 15 is achieved by cooperation between the lugs 55 and the wall 23 of the cylindrical element 20. As these are elastically movable relative to the portion 52 of the cup-shaped body 51 and as their free ends (i.e. those of the feet 56) lie on a circumference of diameter greater than that of the lateral wall 23 of the element 20, the lugs 55 press against the wall 23 to block any oscillation of the pushbutton or knob 1 in planes perpendicular to said axis w.

Figure 9:
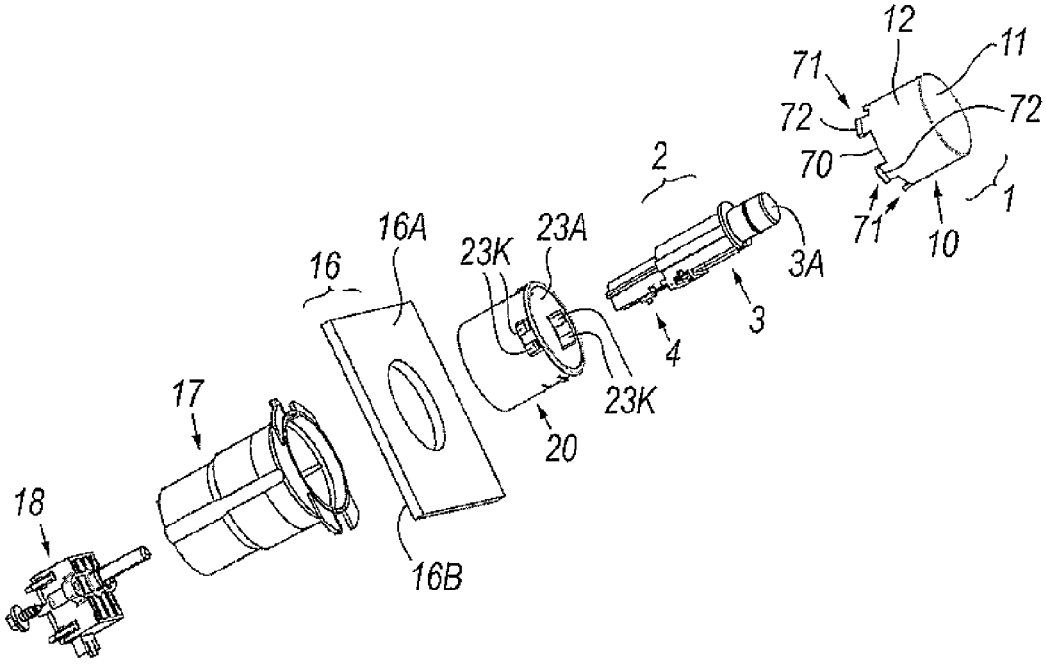
FIG. 9 is an exploded perspective view of another variant of the invention.

In FIG. 9, in which parts corresponding to those of the already described figures are indicated by the same reference numerals, the centering element 20 is shaped similar to that of FIGS. 7 and 8; compared with the already described embodiments, the elements 3 and 4 of the control member 2 lack any part or body arranged to cooperate with the centering element 20 to maintain the knob 1 along the axis W and to prevent its oscillation about this latter. This result is achieved by a particular shaping of the knob 1 which has a second end part 70, defined by the free end of the perimetral wall 12, from which a plurality of lugs 71 project with an enlarged end part 72 arranged to cooperate with the inner face 23A of the lateral wall 23 of the centering element 20.

Each lug can be deformed elastically relative to the wall 12, and has the free surface of the enlarged part lying on a circumference having a larger diameter than the lateral wall 23 of the element 20. By virtue of this, the lugs 71 elastically press with interference against said face 23A, the element 20 hence maintaining the knob 1 centered on the axis W and preventing it from undergoing oscillation about this latter.

The described embodiments are of simple implementation and of low cost in that they require no intervention on the interface 16 for the purpose of modifying its shape at the aperture or seat 15. Moreover they can also be used in already existing and operating household electrical appliances by replacing components and inserting elements defining the invention.

Some embodiments of the invention have been described. Others are however possible in the light of the aforegoing description and are to be considered as falling within the scope of the ensuing claims.

The invention claimed is:

1. A retractable control device for a household electrical appliance comprising, positioned on a control interface of said appliance, a knob movable against an elastic member within an aperture of said interface, the knob being able to assume two working positions, a first working position wherein the knob is inserted in the aperture and a second working position wherein the knob is retracted from the first working position, the knob cooperating with a control member for a functional element of the appliance, the control member being positioned below the control interface, a cylindrical element being disposed and fixed in the aperture of the control interface about the knob, wherein the cylindrical element contains the knob when the knob is in the first working position and guides the movement of the knob within the aperture along a central longitudinal axis thereof, the cylindrical element also blocking oscillation of the knob in planes perpendicular to the axis, wherein the device comprises the following:

wherein the knob movement is guided within the cylindrical element by a body of substantially circular-based frusto-conical cup shape with an end portion provided with a hole for passage of an end of the control member to secure the control member to the knob, the body presenting a plurality of radially distributed elastically movable projections having their free ends lying on a circumference of diameter exceeding that of the perimetral wall of the tubular body of the cylindrical element, said body rigid with the control member being internal to said cylindrical element and having the projections in contact with the perimetral wall of the cylindrical element, said contact centering the knob within the aperture and blocking oscillation of the knob about the axis of movement; and wherein the knob movement is guided through a plurality of radially disposed lugs on the knob with their ends laying on a circumference having a diameter greater than that of the perimetral wall of the tubular body of the cylindrical element, said lugs being elastically deformable and bearing on the perimetral wall of the cylindrical element such as to center the knob on axis of movement and block any oscillation about the axis of movement.

2. The device of claim 1, wherein the control member comprises the elastic member.

3. The device of claim 1, wherein the cylindrical element presents a tubular body and comprises an inner part with which a perimetral part of the knob is in contact when in the first working position, the inner part, by virtue of the contact, maintains the knob centered on the longitudinal axis of the cylindrical element.

4. The device of claim 3, wherein the inner part is the inner face of a lateral wall of the cylindrical element inserted into the aperture.

5. The device of claim 3, wherein the inner part is a cylindrical portion positioned inside and coaxial to the cylindrical element, which has a length at least approximately equal to that of the cylindrical element and being fixed to a lateral wall thereof via an annular part present at one end of the cylindrical element inside the aperture, an annular interspace being defined between the cylindrical portion and the cylindrical element to receive the perimetral wall of the knob when in the first working position.

6. The device of claim 5, wherein the cylindrical portion cooperates with an inner collar positioned along the perimetral wall of the knob, the cylindrical portion penetrating elastically deformable parts cooperating with the collar.

7. The device of claim 3, wherein the annular part present at the end of the cylindrical element is flared towards the longitudinal axis of the knob and presents an inclined portion or surface, the flared annular part being arranged to cooperate with an element at least operationally associated with the knob to prevent oscillation of the knob about the central longitudinal axis through the knob.

8. The device of claim 7, wherein the flared annular part operationally associated with knob is a flanged portion of the control member.

9. The device of claim 1, wherein the cylindrical element comprises elastically deformable lugs, at least one of which presents a coupling element arranged to cooperate with a surface of the user interface facing the appliance interior, the tubular body of this cylindrical element presenting a flanged end to be disposed in the aperture and rest on that surface of the user interface facing the user.

10. A retractable control device for a household electrical appliance, comprising:

a body secured to a control interface of the appliance, the body including an end wall and a cylindrical side wall that define a chamber, a control member positioned in the chamber of the body, the control member including a first element secured to the end wall of the body and a second element moveable relative to the first element, a knob coupled to the second element of the control member and moveable relative to the body, and a centering frame including a shell extending outwardly from an open end of the chamber of the body, the shell including (i) an opening, (ii) a cylindrical inner wall extending inwardly from the opening to a lower inner wall to define an aperture in the shell, and (iii) a hollow shaft extending from the lower inner wall, wherein (i) the hollow shaft of the centering frame extends over the second element of the control member, (ii) an annular passageway is defined between the hollow shaft and the cylindrical inner wall of the centering frame, and (iii) the knob includes a cylindrical outer wall that is positioned in the annular passageway; and wherein the retractable control device comprises:

the control member cooperating with a body of substantially circular-based frusto-conical cup shape with an end portion provided with a hole for passage of an end of the member to secure the control member to the knob, the body presenting a plurality of radially distributed elastically movable projections having their free ends lying on a circumference of diameter exceeding that of the cylindrical inner wall, the body rigid with the control member being internal to said centering frame and having a plurality of projections in contact with the perimetral wall of the centering frame, the contact centering the knob within the aperture and blocking oscillation about the axis of movement of the knob;

at that end inserted into the aperture, the knob presenting a plurality of radially disposed lugs with their end laying on a circumference having a diameter greater than that of cylindrical outer wall, said lugs being elastically deformable and bearing on the cylindrical outer wall such as to center the knob on the longitudinal axis of the aperture and block any oscillation about that axis.

* * * * *